US010188925B2

(12) United States Patent
Freund

(10) Patent No.: US 10,188,925 B2
(45) **Date of Patent: *Jan. 29, 2019**

(54) BALL REBOUNDING SYSTEM

(71) Applicant: Sportworx, LLC, Imperial, MO (US)

(72) Inventor: Kurt T. Freund, St. Louis, MO (US)

(73) Assignee: SPORTWORX, LLC, Imperial, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/450,157

(22) Filed: Mar. 6, 2017

(65) Prior Publication Data

US 2017/0173435 A1 Jun. 22, 2017

Related U.S. Application Data

(63) Continuation of application No. 14/034,253, filed on Sep. 23, 2013, now Pat. No. 9,586,117.

(Continued)

(51) Int. Cl.

*A63B 69/00* (2006.01)
*A63B 47/00* (2006.01)
*A63B 71/02* (2006.01)

(52) U.S. Cl.

CPC ..... *A63B 69/0097* (2013.01); *A63B 47/00* (2013.01); *A63B 71/022* (2013.01);

(Continued)

(58) Field of Classification Search

CPC ... A63B 69/0097; A63B 63/00; A63B 63/004; A63B 69/0002; A63B 71/0002; A63B 2069/0006

(Continued)

(56) References Cited

U.S. PATENT DOCUMENTS 1,675,249 A 6/1928 Carver
2,992,002 A 7/1961 Bingham, Jr.

(Continued)

FOREIGN PATENT DOCUMENTS

CN 2259204 Y 8/1997
FR 2562431 A1 10/1985

OTHER PUBLICATIONS

Abstract of CN2259204Y, mechanical translation by European Patent Office.

(Continued)

*Primary Examiner* — Mark Graham
(74) *Attorney, Agent, or Firm* — Thompson Coburn LLP

(57) ABSTRACT

A ball rebounder has inelastic netting that is pulled taught and held in place within a frame using tension rods, inelastic fasteners, and a tensioning mechanism between the frame and the tension rods. The tension rods are connected to the cells of the netting and positioned in the interior space. The tensioning mechanism pulls the tension rods toward the corresponding sides of the frame, drawing the net taught within the frame. With the netting pulled taught, the fasteners hold the tension rods in place next to the sides of the frame. The frame can be rigid or may have flexibility and act like a spring, but there are no intermediate springs between the tension rods and the frame or between the tension rod and the netting. The invention can be used in producing new rebounders and in retrofitting existing rebounder frames.

10 Claims, 25 Drawing Sheets

Related U.S. Application Data

(60) Provisional application No. 61/704,455, filed on Sep. 22, 2012, provisional application No. 61/786,462, filed on Mar. 15, 2013.

(52) U.S. Cl.
CPC ... *A63B 2071/024* (2013.01); *A63B 2071/025* (2013.01); *A63B 2210/50* (2013.01); *A63B 2225/09* (2013.01); *Y10T 29/49826* (2015.01)

(58) Field of Classification Search
USPC ..... 273/395, 396, 398–402; 473/434, 435, 473/431, 476–478
See application file for complete search history.

(56) References Cited

U.S. PATENT DOCUMENTS

| | | | | |
|---|---|---|---|---|
| 3,195,898 | A | 7/1965 | Respini | |
| 3,427,026 | A | 2/1969 | Mahoney | |
| 3,836,144 | A * | 9/1974 | Mahoney | A63B 69/0097 248/130 |
| 4,082,271 | A | 4/1978 | Martin | |
| 4,239,235 | A | 12/1980 | Torres | |
| 4,264,070 | A | 4/1981 | Torres | |
| 4,274,632 | A | 6/1981 | Jacobs | |
| 4,489,941 | A | 12/1984 | Shieh | |
| 4,553,751 | A | 11/1985 | Ketchum | |
| 4,830,372 | A | 5/1989 | Outlaw et al. | |
| 4,948,147 | A | 8/1990 | Pallanca | |
| 5,048,844 | A | 9/1991 | Haseltine | |
| 5,615,889 | A | 4/1997 | Long | |
| 5,664,784 | A | 9/1997 | Redlich et al. | |
| 5,816,956 | A | 10/1998 | Ellis et al. | |
| 5,833,234 | A | 11/1998 | Vavala et al. | |
| 5,857,679 | A | 1/1999 | Ringe et al. | |
| 5,906,552 | A | 5/1999 | Padilla | |
| 6,209,877 | B1 | 4/2001 | Warnick | |
| 6,210,288 | B1 | 4/2001 | Kim | |
| 6,299,544 | B1 | 10/2001 | Schwarzler et al. | |
| 6,511,390 | B2 | 1/2003 | Kim | |
| 6,893,364 | B1 | 5/2005 | Grunfeld | |
| 8,246,496 | B2 | 8/2012 | Holland et al. | |
| 9,586,117 | B2 * | 3/2017 | Freund | A63B 69/0097 |
| 2002/0013187 | A1 | 1/2002 | Grunfeld | |
| 2003/0060309 | A1 | 3/2003 | Smith | |
| 2006/0116226 | A1 | 6/2006 | Padilla | |
| 2008/0067751 | A1 | 3/2008 | Hunt | |
| 2009/0181810 | A1 | 7/2009 | Stephenson | |
| 2010/0304902 | A1 | 12/2010 | Holland et al. | |
| 2011/0015002 | A1 | 1/2011 | Brown | |
| 2011/0053713 | A1 | 3/2011 | Bulloch | |
| 2011/0059815 | A1 | 3/2011 | Jones | |
| 2012/0208658 | A1 | 8/2012 | Christgau et al. | |
| 2015/0151179 | A1 | 6/2015 | Holland et al. | |

OTHER PUBLICATIONS

Abstract of FR2562431A1, mechanical translation by European Patent Office.
Chinese Search Report, CN Application No. 2013800604166, dated May 31, 2016, 2 pages.
International Search Report with Written Opinion of the International Searching Authority, PCT/US2013/061216, dated Feb. 18, 2014.
Supplementary European Search Report, EPO App. No. EP13839126, dated Sep. 20, 2016, 2 Pages.
Supplementary Partial European Search Report, EPO Application No. 13839126, dated Jun. 7, 2016, 1 page.

* cited by examiner

BALL REBOUNDING SYSTEM

CROSS-REFERENCE TO RELATED APPLICATIONS

This application claims priority to U.S. patent application Ser. No. 14/034,253 filed on Sep. 23, 2013 which claims priority to U.S. Provisional Patent Application Nos. 61/704,455 and 61/786,462 respectively filed on Sep. 22, 2012 and Mar. 15, 2013, all of which are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to ball rebounding devices, and more particularly to rebounding systems in which a tensioning device pulls the net taut within a frame.

Related Art

Ball rebounding devices are used for many sports. Most ball rebounding devices use bungee cords or some other spring mechanism to hold nets and other fabrics within the frame, such as in U.S. Pat. Nos. 2,992,002, 4,489,941, 5,833,234 and 6,299,544 while other ball rebounding devices have a flexible margin between the net and the frame, such as in U.S. Pat. Nos. 5,615,889 and 4,082,271. However, these spring elements and flexible margins reduce the overall tension in the net, thereby reducing the rebound effect of the rebounding device, i.e., the amount of a ball's potential energy, or other projectile, that is converted into kinetic energy when the projectile hits the net. Conversion of the potential energy is lost through the springs. Additionally, these known systems lose their rebounding capacity over time as the spring mechanisms or other flexible margins rotate through thousands of expansion and contraction cycles in response to balls being thrown against the nets. The spring-supporting frames of these known rebounders are much more rigid than the springs that hold the nets and do not provide any additional spring flexibility or spring-loading into the overall rebounding system.

Some ball rebounding devices have a rigid margin within an outer frame and have eliminated the springs between the rigid margin and the frame, such as in U.S. Pat. No. 6,209,877 and US Patent App. Pub. No. 2012/0208658, and while these inner/outer frame systems have the capability to pull much higher tensions through the net, their designs are inefficient. In particular, previously known inner/outer frame systems limit the size of the net's cells and the locations in which the net's cells can connect to the inner frame based on the locations of connection elements, such as through-holes for lacing the net's cells or knobs for holding the net's cells. Additionally, these known inner/outer frame systems require the inner frame to be pulled toward the outer frame by individual fasteners that are distributed between the lengths of the frames and do not allow the entire inner frame to be pulled in whole toward the outer frame, simultaneously along the entire length. This inefficiency in the pulling reduces the overall tension that can be obtained and increases the time and cost of manufacturing.

The designs of double-frame systems are also rather inflexible and rigid in order to maintain an equal distance between the inner frame and the outer frame along the length of the frames. They do not provide a flexible outer frame, and the inner frame portions of these known inner/outer frame systems are uniquely designed for their respective outer frames and cannot be used to replace the spring and net systems found in most existing rebounding devices. Accordingly, none of the prior ball rebounding devices could be used as a retrofit system that would be able to be used within existing spring-supporting frames because these frames are only designed to support the lower tensions produced by bungees or other spring mechanisms, and these frames cold not support the higher tensions in these double-frame systems. Also, many of these double-frame systems have holes that must be drilled through the outer frame at particular locations in order to hold the inner frame, and if these holes were to be drilled into the spring-supporting frames, it would further reduce their support capacity and may even compromise the structural integrity of the spring-supporting frames.

There remains a need for a ball rebounding device that can create high tension in nets and can be used with different types of nets, including nets that have different sized cells. It would be another benefit for a ball rebounding system to have structural features which allow for faster and more efficient assembly methods. It would be an additional benefit for a ball rebounding system to be capable of retrofitting the nets and springs or fasteners in existing ball rebounding frames with replacement nets, tension rods and fasteners according to the present invention to provide a better rebound effect or to retrofit the existing frames with an entire frame-rod-net system that can be installed without compromising the structural integrity of the existing frames. It would be another benefit to retrofit the nets in a manner that is less time consuming than the process necessary to install the original nets. It would be another benefit for a ball rebounding system to have a frame which deflects with a spring action as tension is pulled on the net being held in place by the frame.

SUMMARY OF THE INVENTION

The present invention is directed to a ball rebounding device with high tension netting that is efficiently assembled, pulled taught and held in place within a frame using a tension rod system and a manufacturing process that uses levers between the frame and tension rods within the frame. The invention can be used in producing new ball rebounder and in retrofitting existing rebounder frames. The frame provides a perimeter support and an interior space. Tension rods are run through the cells of the netting and positioned in the interior space. A lever system is connected between the tension rods and the frame to pull the tension rods toward the corresponding sides of the frame, thereby drawing the net taught within the frame. Once the netting is pulled taught, fasteners hold the tension rods in place next to the sides of the frame. In one embodiment, the frame is very rigid and does not flex as the tension is placed on the netting. In another embodiment, the frame members have some flexibility and bow as the tension is placed on the netting.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
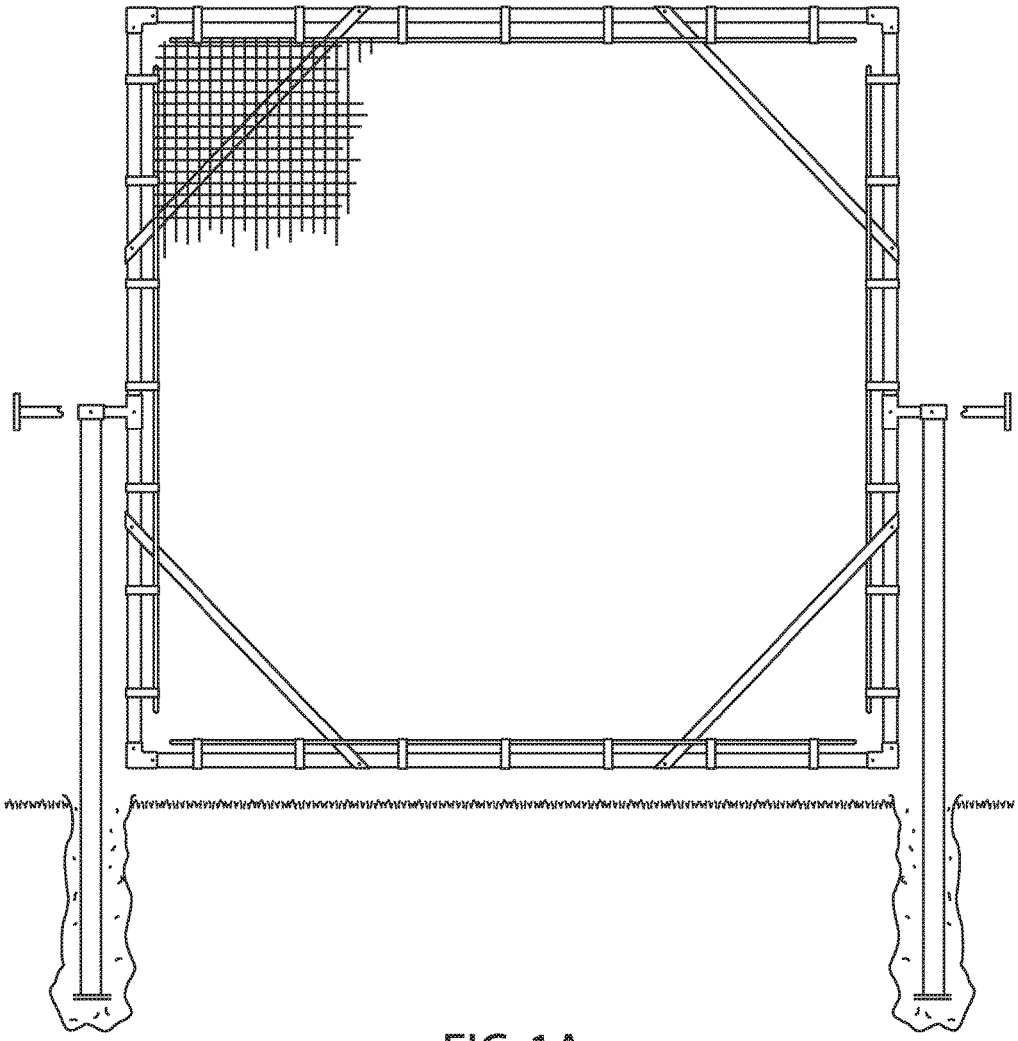
FIGS. 1A & 1B are front views of the rebounder device.
Figure 1B:
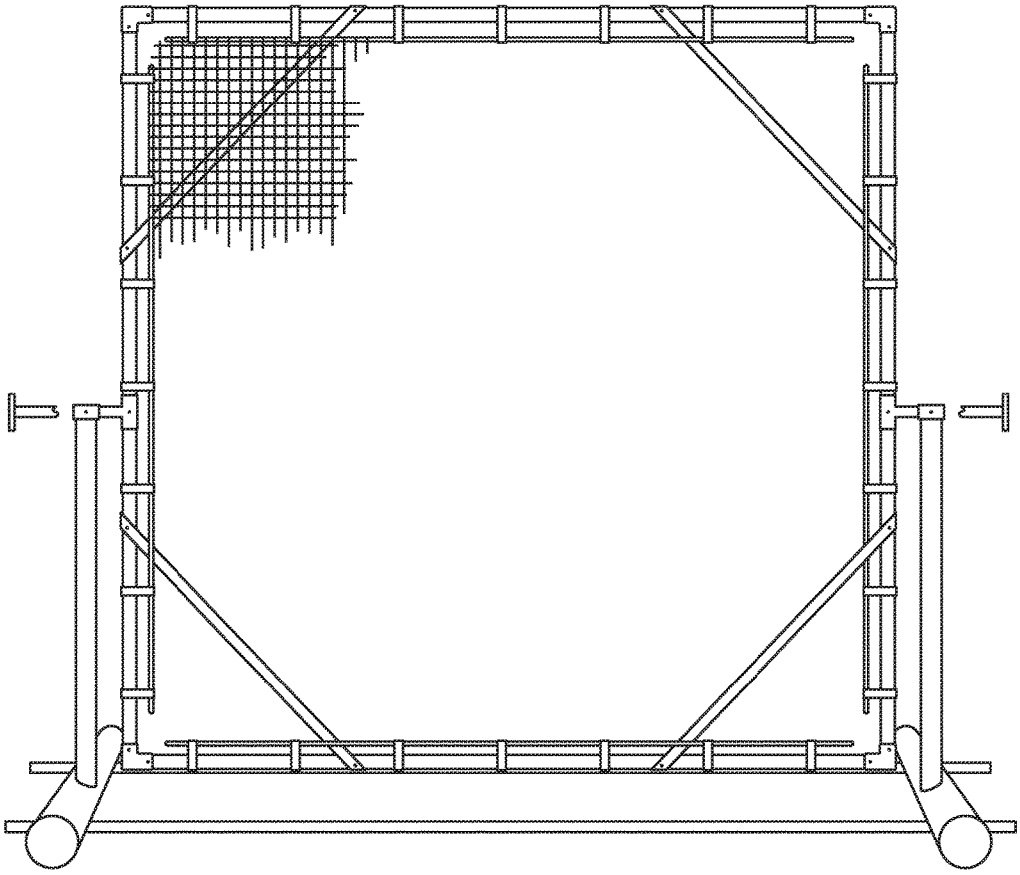
Figure 2:
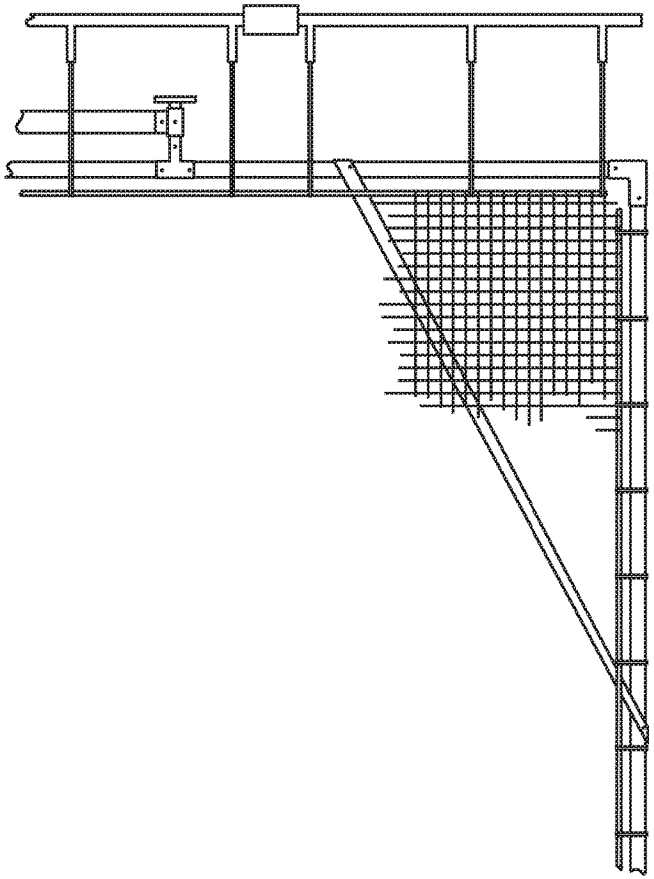
FIG. 2 is a front view of the rebounder device with a lever system.
Figure 3A:
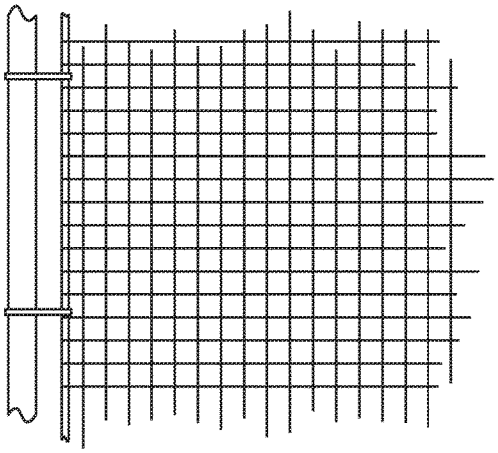
FIGS. 3A-3D are views of alternative fasteners for the rebounder device.
Figure 3B:
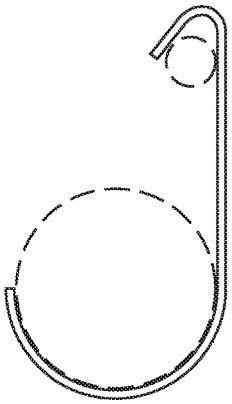
Figure 3C:
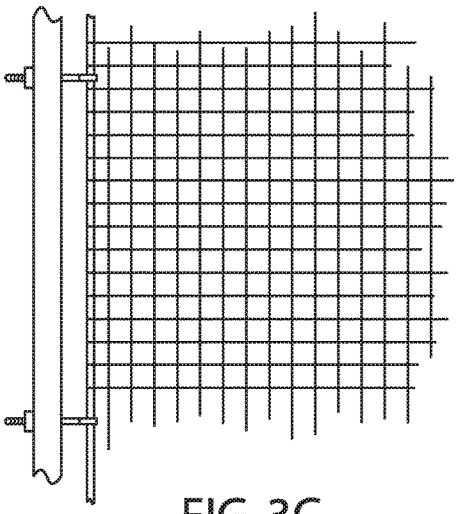
Figure 3D:
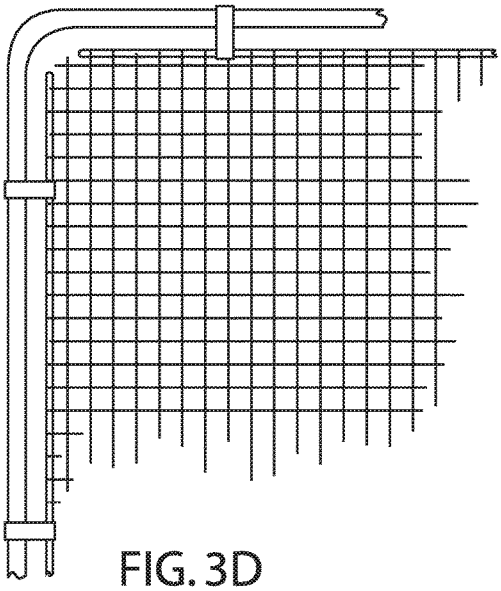
Figure 4A:
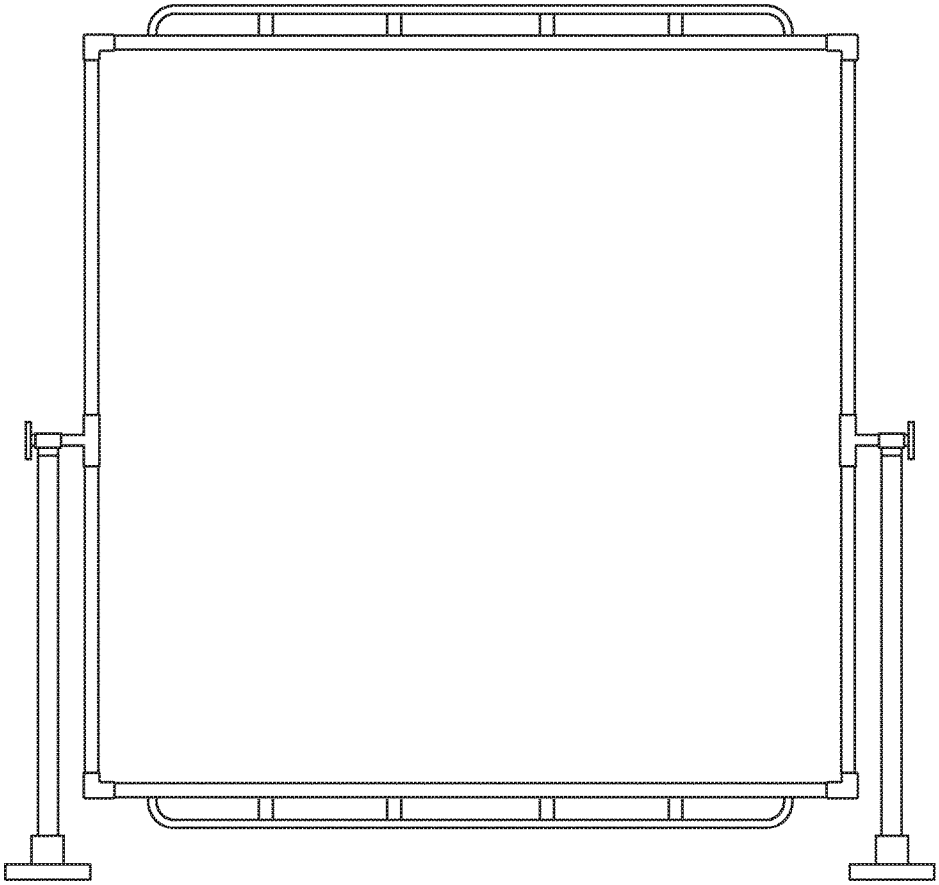
FIGS. 4A & 4B are front views of a rebounder frames with external trusses.
Figure 4B:
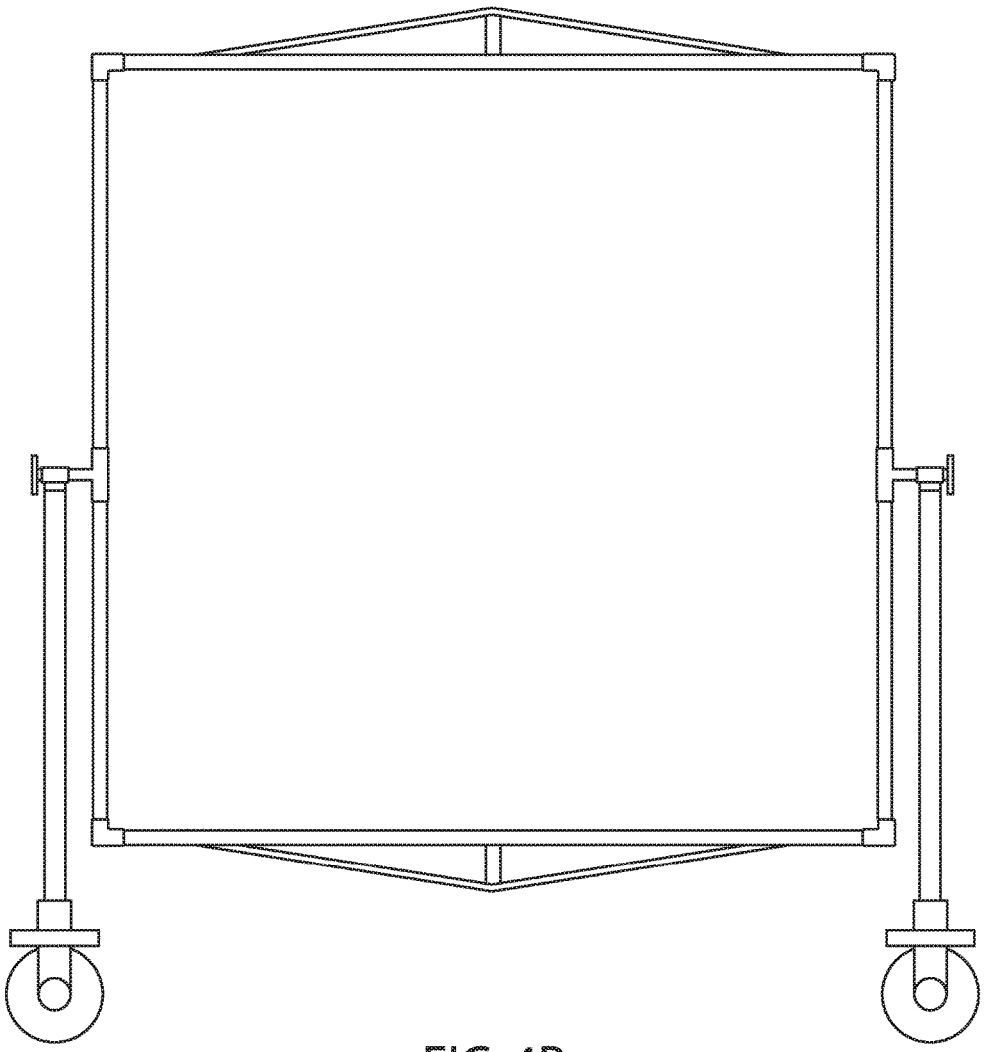

As illustrated in FIGS. 1-3, the ball rebounding system of the present invention has tension rods that are laced by the cells of a net and that hold the net within the interior space of a frame. The invention also includes a lever system which pulls the tension rods toward the frame's perimeter support and thereby pulls the net taut and produces tension within the net. Fasteners hold the tension rods to the frame. The frame preferably includes a bracing system, and as illustrated in FIGS. 1, 2, 4 and 5 and described in further detail below, a variety of braces can be used to provide additional support to the frame. The frame is rotatably held by a pair of tilting hubs or other rotation brackets that are mounted to a corresponding pair of posts, and as illustrated in FIGS. 1, 4 and 7, the posts can be fixed to a ground foundation, installed on a stationary mount or positioned on a mobile platform.

Figure 7A:
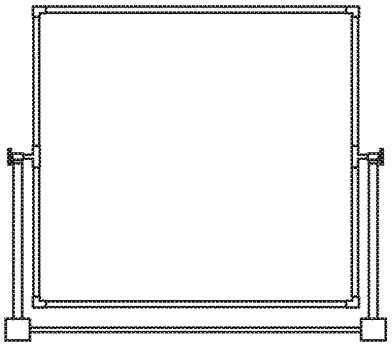
FIGS. 7A-7J are views of rebounders with various mounting arrangements.
Figure 7B:
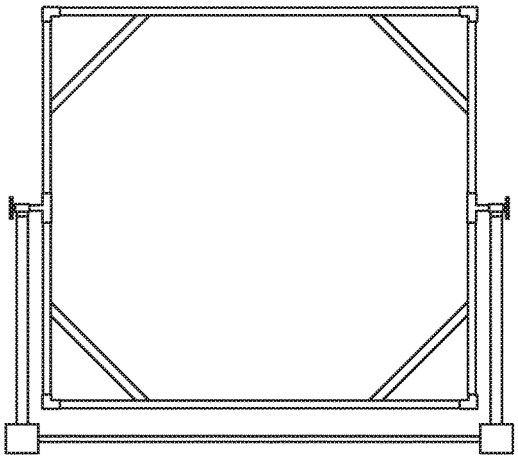
Figure 7C:
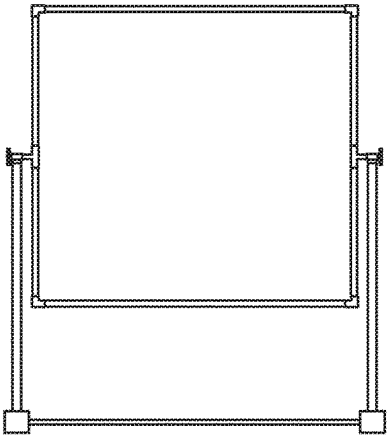
Figure 7D:
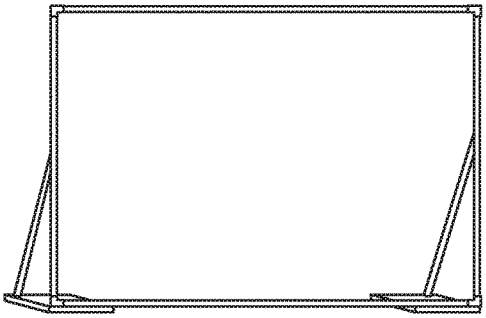
Figure 7E:
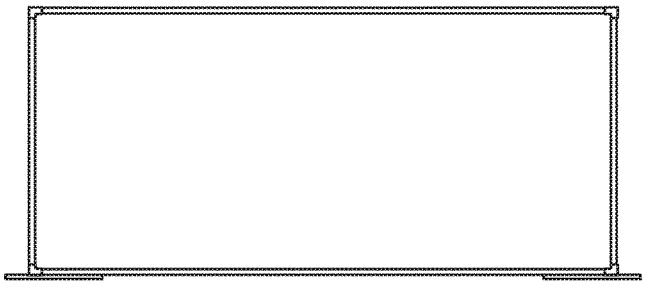
Figure 7F:
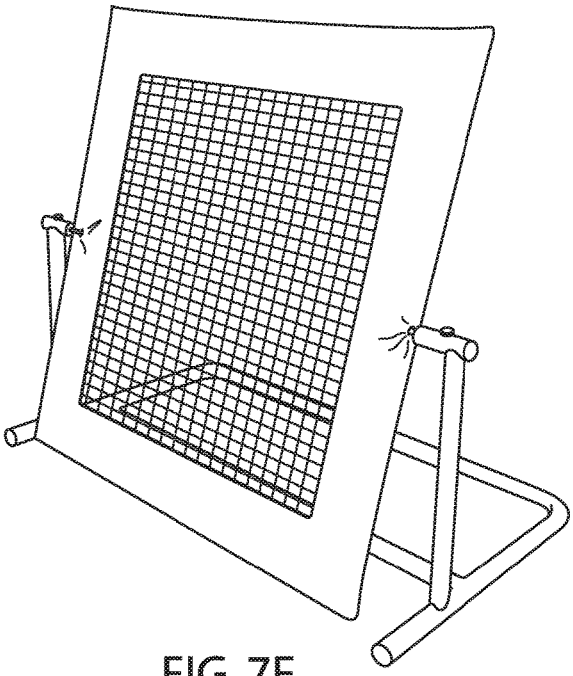
Figure 7G:
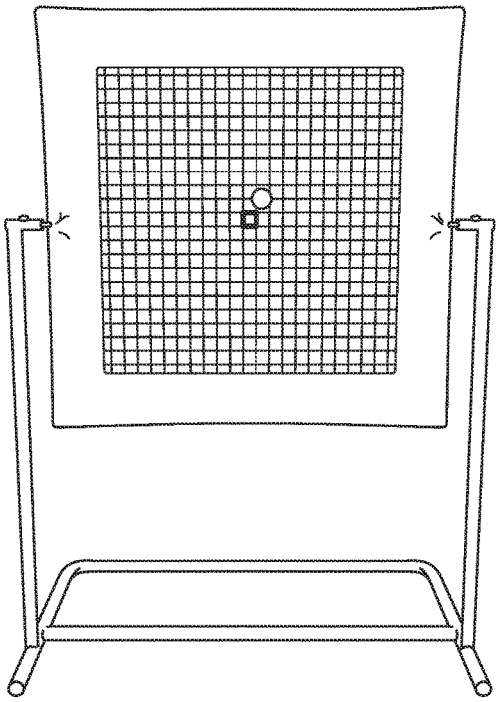
Figure 7H:
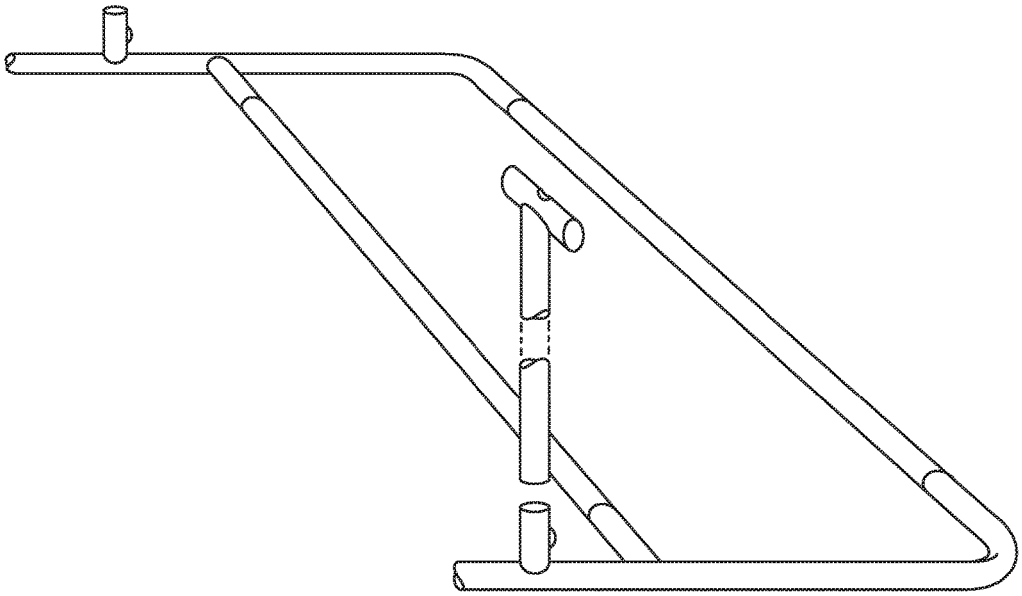
Figure 7I:
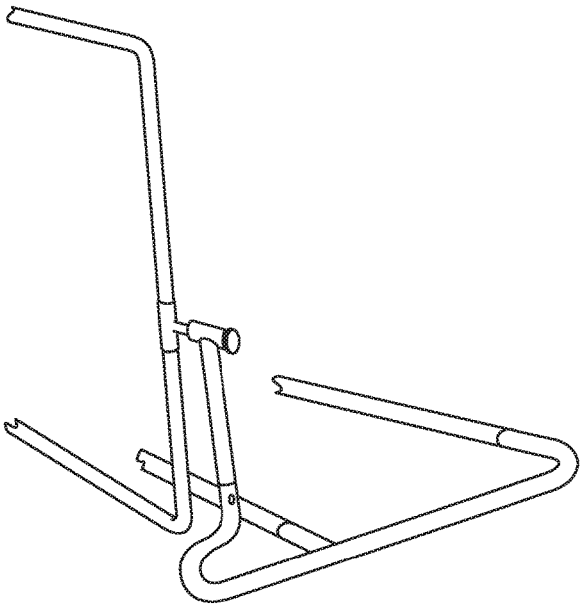

As illustrated in FIG. 7, the ball rebounding system of the present invention can be incorporated into different frames shapes and sizes, and the inventive elements can be retrofitted into existing ball rebounding frames that can withstand the increased tension provided by the present invention. As with other rotatable rebounding devices, the frame rotates to change the inclination of the rebounding action. As particularly shown in FIGS. 7A, 7B and 7C, various aspects of the frame can be modular. For example, a set of short side legs can be replaced with a set of longer side legs or with a set of side leg extensions to elevate the frame away from the ground. Padding can be placed around the periphery of the frame, and a skirt or other covering can be wrapped over the padding, the frame and the tension rods, and the ends of the covering can be glued, epoxied or otherwise secured together around the net or directly to the net if it is a fabric material. Additionally, as shown in FIG. 8, dead blow sheeting can be hung from the top of the frame to transform the rebounder into a ball catcher.

Figure 9A:
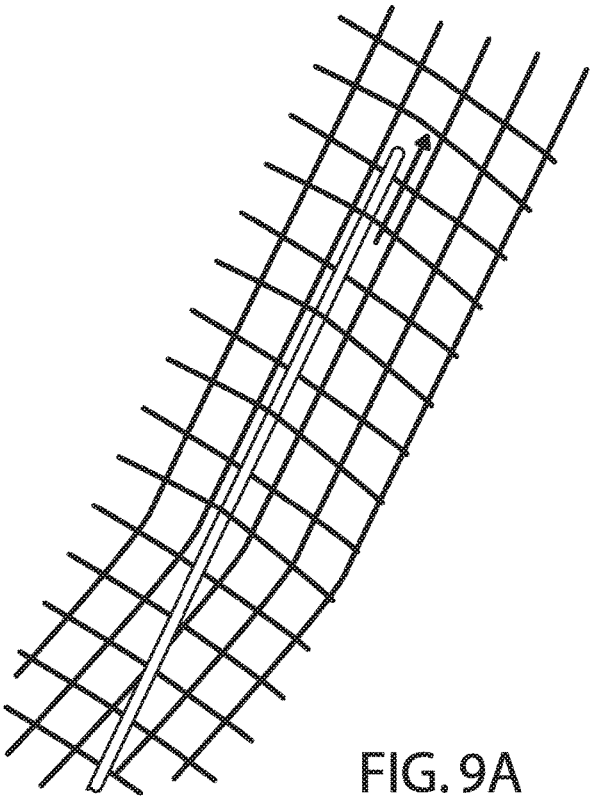
FIGS. 9A-9G are views of a method of assembling the rebounder.
Figure 9B:
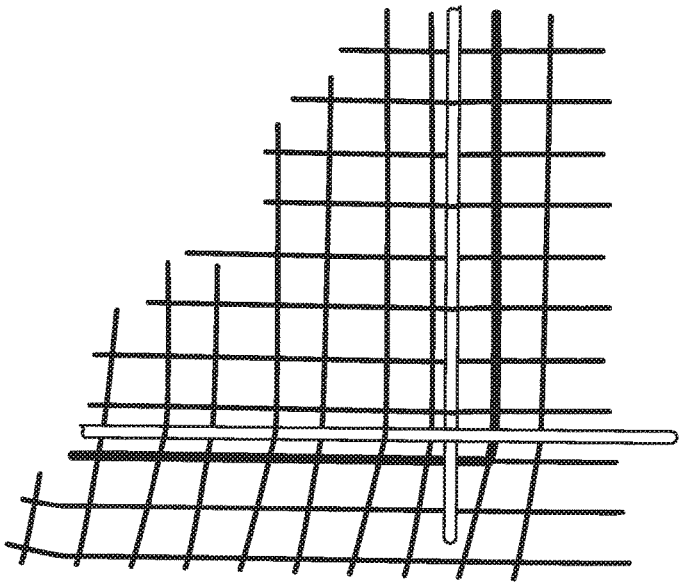
Figure 9C:
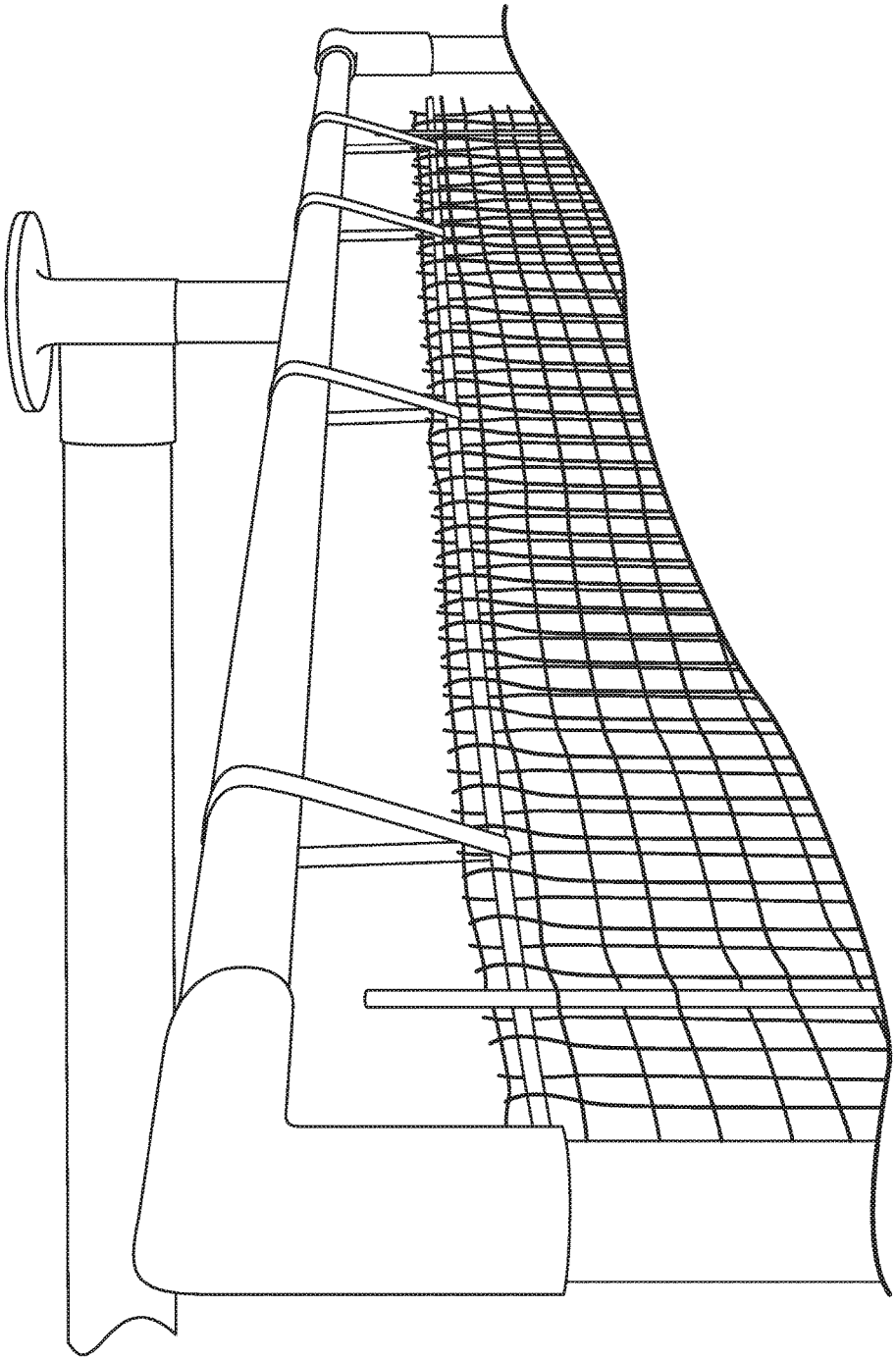

The construction of the ball rebounding system is shown in FIGS. 9A-9G. In one embodiment, four perimeter supports form the top, bottom and sides of the frame. The vertical sides slide into the tilting hub's T-joints which are centered on each corresponding side. The T-joints can be secured to the posts by any fastener, and the embodiment illustrated in FIG. 9C, shows set screws. Corner sleeves connect the top and bottom perimeter supports to the vertical perimeter supports. The braces are attached to provide additional support. The frame is rotatably fixed to the posts through the tilting hubs.

When the net is slack, it is laced onto the tension rods as shown in FIG. 9A. Preferably, the net has marked runs through which the rods can be quickly positioned and inserted as shown in FIG. 9B. The rows of cells that form the marked runs in the net are preferably surrounded by at least one additional row of cells so that the net is slightly oversized and the marked runs are not at the edge of the net. With this slightly oversized net, hot knife cutting can be used to cut the end rows of cells at the net's boundary. It will also be appreciated that it may be helpful to mark the center of the net to help center it on the rods within the frame (see FIG. 7G). The marking of the net's center or the use of marked runs could be particularly helpful with the installation of the net and tension rods within the frame because the rows of cells are directly laced onto the tension rods without any intermediate spring elements and are freely aligned along the tension rods relative to the perimeter support without any cell-position limitations or cell-size limitations according to any position or size requirements of connection points on the frame. Accordingly, nets with different sized cells or screens or other fabrics with various spacing of margin holes can be used within the same frame structure. For screens or other fabrics which have reinforced holes along their margins, the holes are sized to be larger in diameter than the tension rod.

The tension rods with the laced net are preferably arranged orthogonally within the frame's interior space and are loosely held in place by cam straps, bungee cords or other temporary fixtures or jig elements. As particularly illustrated in FIG. 9C, the tension rods are spaced apart from the perimeter support within the interior space when they are held by the cam straps. The cam straps can be used to hold each one of the tension rods in this spaced relationship. Alternatively, one pair of orthogonally arranged rods can be held in their secured position with fasteners proximate to the perimeter support while the opposite pair of rods are held by the cam straps. As illustrated in FIG. 3, different types of fasteners can be used to hold the rods in their secured position, including different forms of hooks, clamps, bolts, straps and ties, such as a C-hooks, S-hooks, J-bolts, C-clamp, wire-ties, etc. As explained in detail below, straps may be used to hold the rods loosely in position and may also be used with a lever and/or a strap tensioner to pull the rods toward the frame and permanently secure the rods proximate to the frame. It will be appreciated that various non-orthogonal arrangements of tension rods may also be used, particularly including curved tension rods (not shown). Also the tension rods do not necessarily need to be threaded along the same row of cells in the net, and the net can be arranged diagonally relative to the tension rods.

Figure 9D:
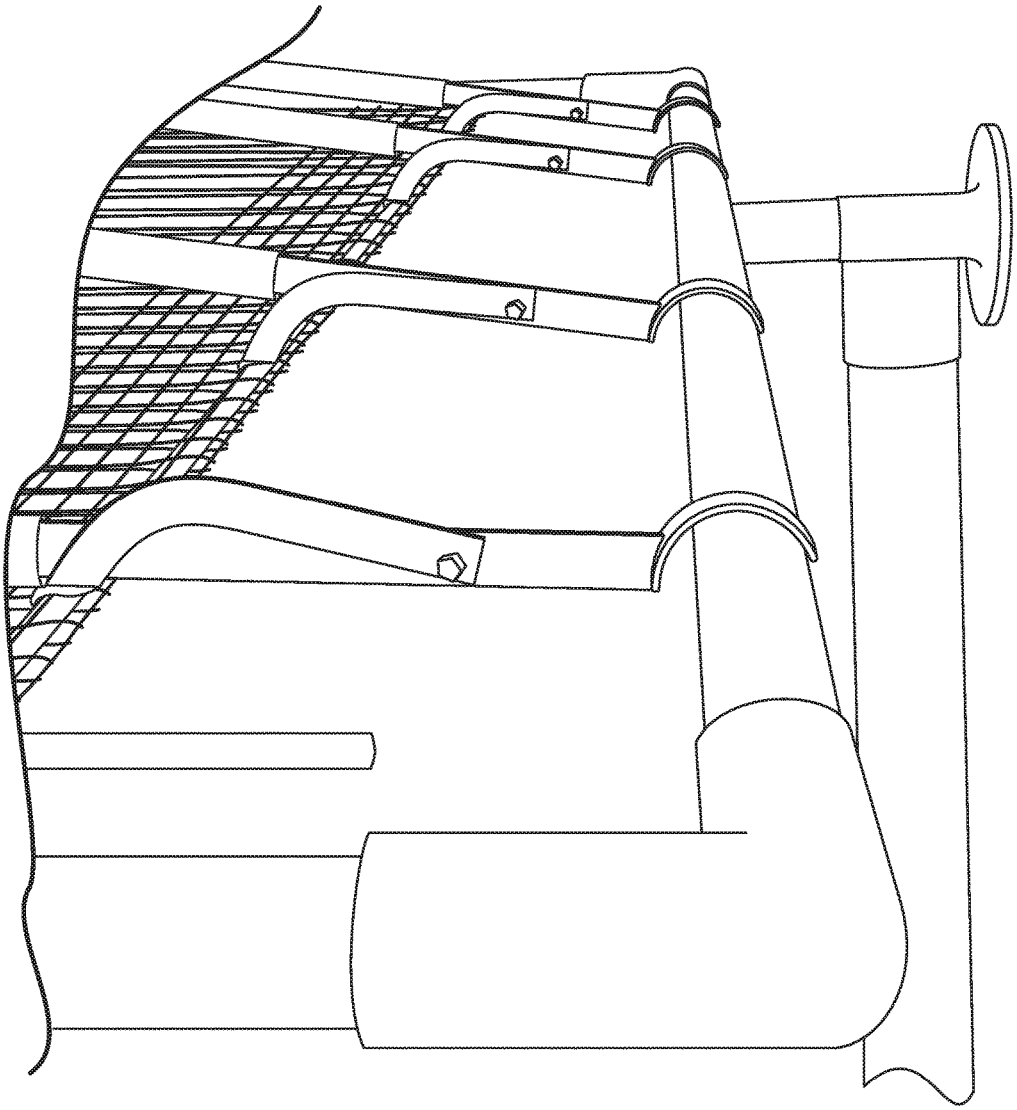
Figure 9E:
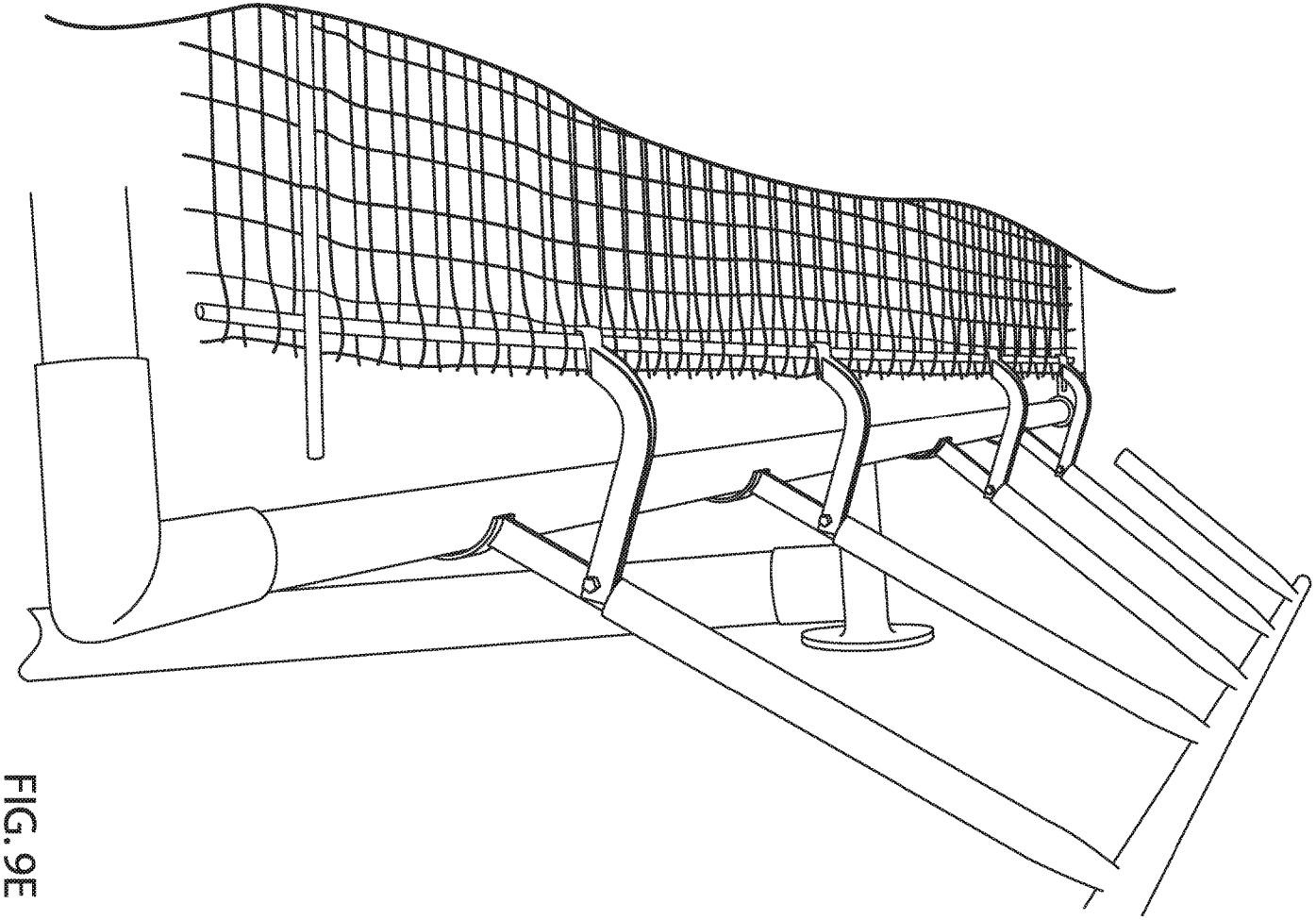
Figure 9F:
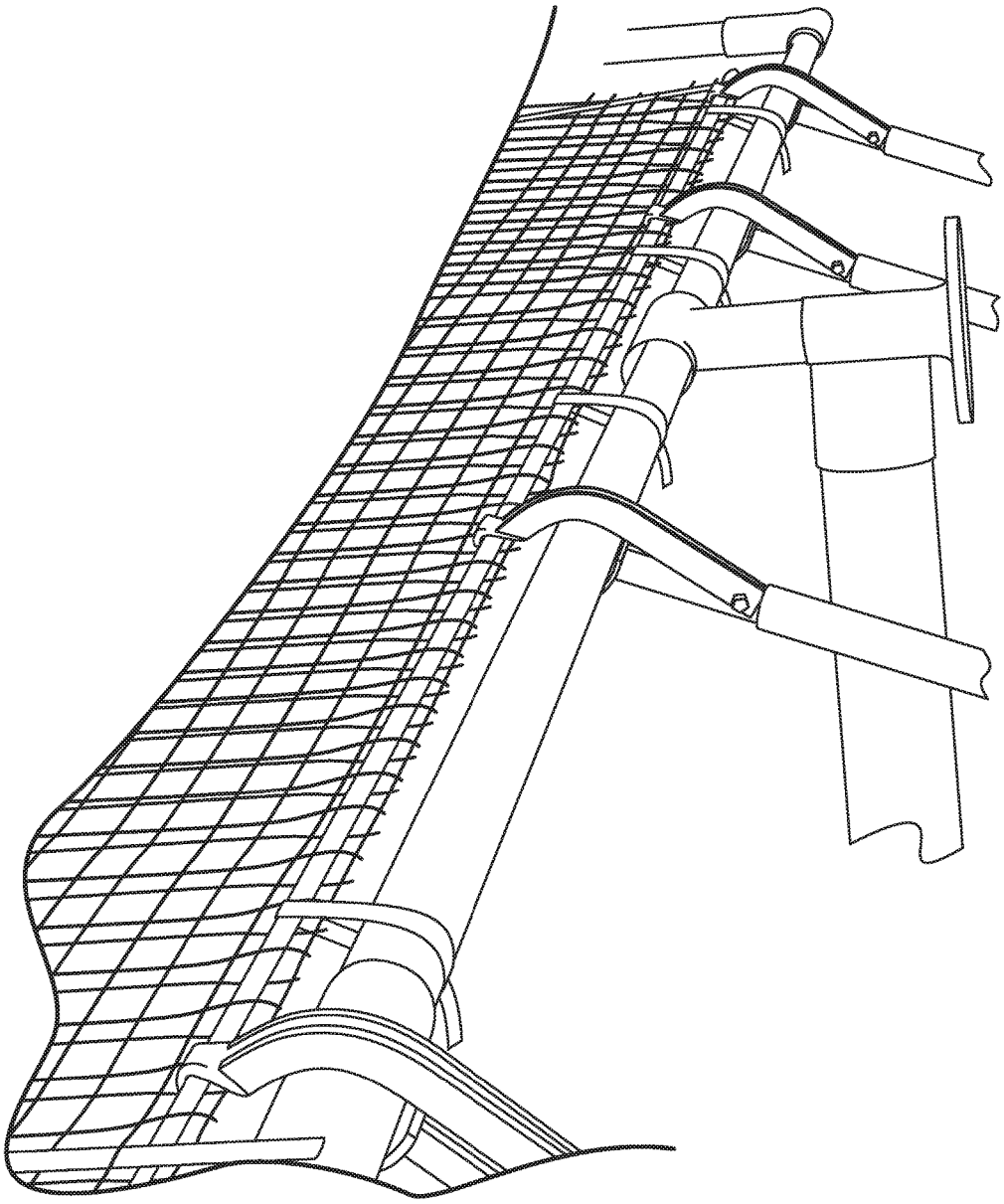

As shown in FIGS. 9D-9F, the lever system is connected between the frame's perimeter support and the spaced rods. The lever pulls the tension rod from its spaced position to its secured position, thereby pulling the net from its slackened state to a taut state. When the rod is in its secured position, it is held in place with fasteners. In one embodiment, the lever system is temporarily connected between the rod and the frame so that it can be removed when the fasteners are installed. In another embodiment, the lever system can be permanently fixed between the frame and the rod so that it pulls the rod through the fasteners that secure the rod to the frame. In the preferred embodiment, the net is orthogonally pulled taut. Accordingly, the rod that is adjacent to the rod in its secured position should also be pulled from its spaced position to its secured position and then fixed in place. It will be appreciated that this lever pulling process can be performed on one pair of orthogonally arranged rods while the other pair is securely fixed in place on the frame with fasteners from the start or can be performed on each one of the rods if they all are initially held in place in their respective spaced position.

The lever system preferably operates on the entire length of the tensioning rod simultaneously. Generally, the lever system operates on at least two spaced-apart locations on the rod, and there are preferably three or more locations, with at least two being closer to the ends of the rod and at least one location being toward the center of the rod. The furthest distance between these spaced-apart locations on the rod is preferably at least one half of the rod's length. In the particular embodiment that is shown, the lever system has lever bars and a cross-bar connected between the lever bars, and the lever bars are spaced apart on the frame. The lever bars can be variations of existing lever tools, such as a fence stretcher in the form of a hand tensioner which has an elongated lever arm with a frame-grip at one end, a hand-grip at an opposite end and a rod-grip extension rotatably connected to the lever arm between a middle point and the frame-grip. While this embodiment is shown with a hand operated lever system, it will be appreciated that the lever system can be used within jigs and automated tooling machines.

Figure 9G:
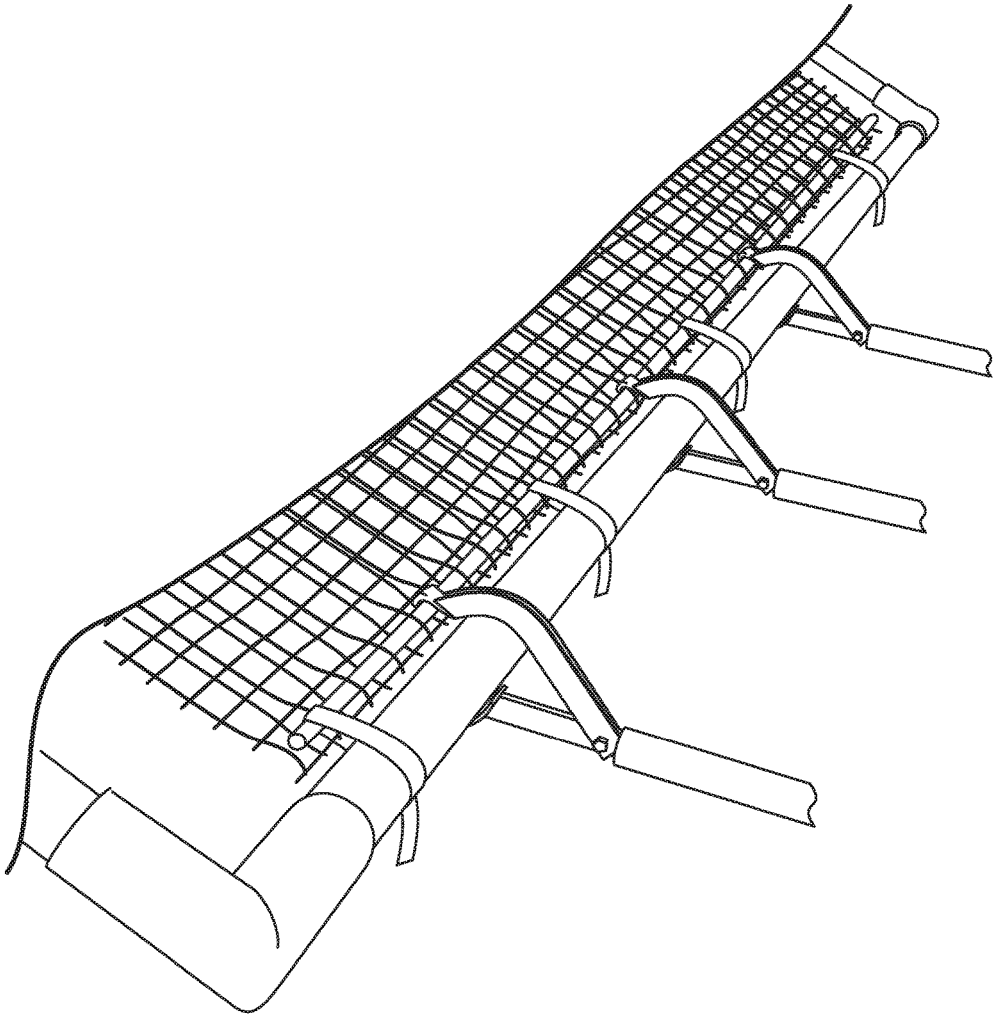

In FIG. 9G, a lever system is shown which acts on one end of a tensioning rod with the other end of the rod bending toward the rod's spaced position. With this arrangement, once the one end is secured, the other end can then be pulled with the same lever system. Although the lever system can operate along sections of the rod as shown in FIG. 9G or at individual points along the rod, such as could be done with a socket wrench torque-down on the J-bolts in FIG. 3, the lever system which operates along substantially the entire rod is preferred for the greatest efficiency. For smaller frames, this may only be two or three spaced levers, and there could be more for larger sized frames. For example, the lever systems shown in FIGS. 2 and 9D each have a coupler which connects two cross-bars.

It will also be appreciated that the lever system can a single leveraging mechanism with spaced-apart rod holders or multiple leveraging mechanisms spaced along the frame. Various alternative leverage mechanisms are shown in FIG. 10. Generally, any leveraging mechanism could be used, including a winch, a ratchet lever, a fence stretcher, a pull jack, a ratchet strap or ratchet buckle. The various leveraging mechanism options can be used in conjunction with optional fasteners. For example, one pair of orthogonal rods could be fixed to their secured position by J-bolts or C-hooks while the other pair of orthogonal rods are loosely held by ratchet straps or ratchet buckles along the frame. The ratchet straps could be operated in unison with a cross-bar connected to the levers on the ratchet straps.

Figure 5A:
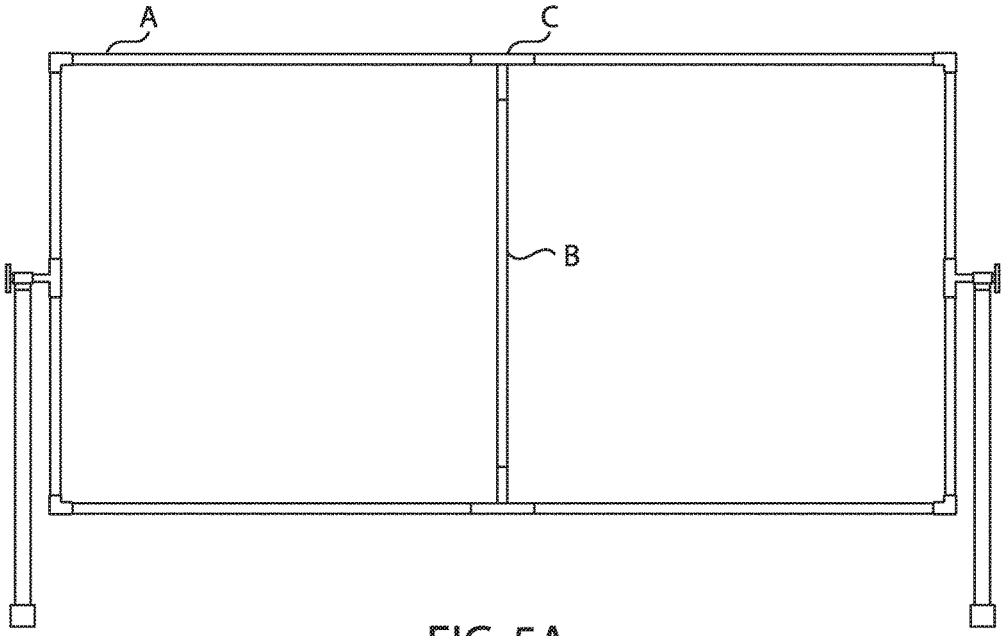
FIGS. 5A & 5C are front views of rebounder frames with alternative bracing.
Figure 5B:
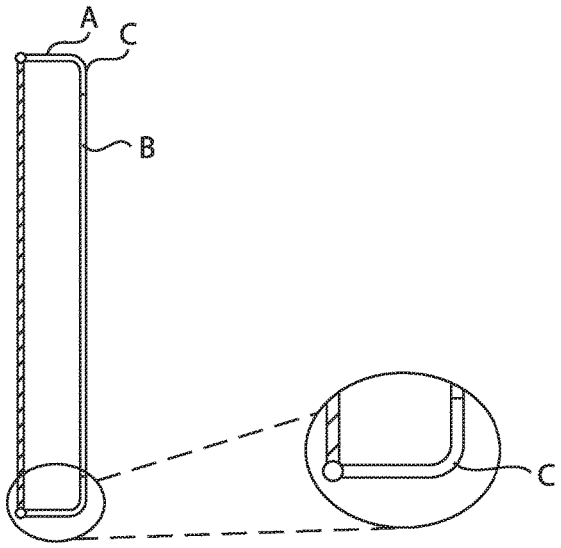
FIG. 5B is a side view of the rebounder frame shown in FIG. 5A.
Figure 5C:
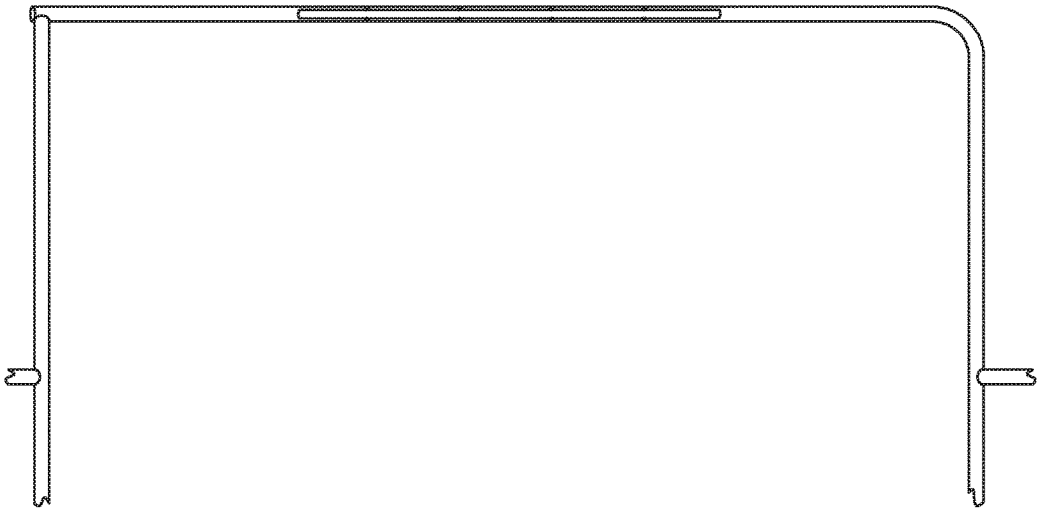
Figure 5D:
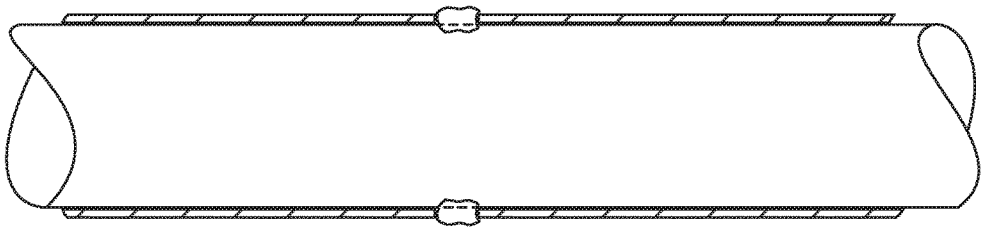
FIG. 5D is a detail view of the rebounder frame shown in FIG. 5C.

Different types of braces can be used to provide additional strength to the perimeter support which can be formed from rods, bars, tubes, beams, and any combination thereof. Most of the braces span a portion of the frame's interior space, but external truss braces can also be used, such as shown in FIG. 4. External trusses can be positioned on the top and bottom as shown or on the sides to permit the net to reach the ground. It is also possible for these trusses to be positioned within the frame's interior space and may even have an arm that extends behind the back side of the net, such as shown in FIGS. 5A and 5B. Accordingly, interior braces can be a truss or arm that spans the inside perimeter support or can be a bracket that is situated in the corners of the perimeter support. Another form of an interior brace is an inner sleeve that is situated within the tubular frame as shown in FIG. 5C. The inner sleeve provides localized rigidity to the frame. In one embodiment, the inner sleeve is positioned toward the center of the tubular frame and is spot welded in place.

Figure 6A:
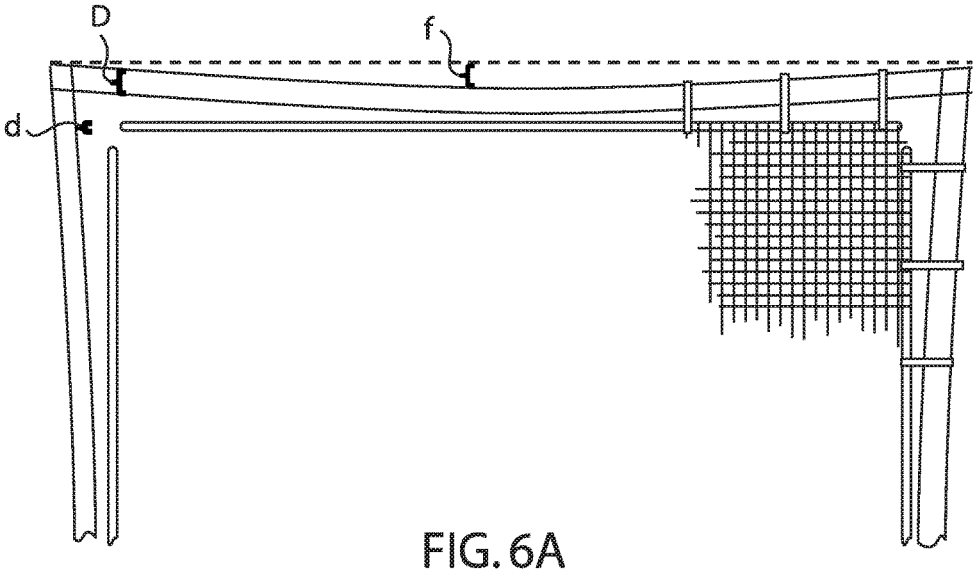
FIGS. 6A & 6B are front and side views of a rebounder with a flexible frame.
Figure 6B:
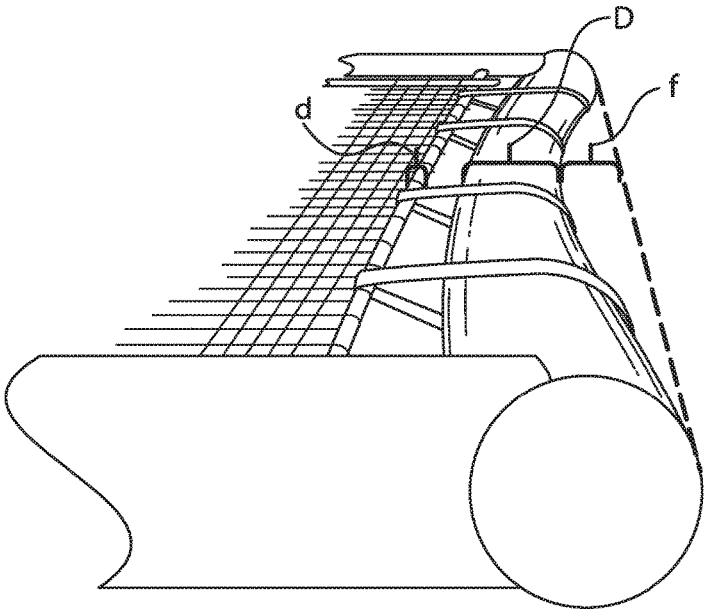

As shown in FIGS. 6A and 6B, the frame can deflect with a spring action in response to the tension that is pulled on the net. It is known from existing rebounding devices that most nets and their spring elements to the frames wear far more than the frames themselves and would produce slack in the netting, further reducing the rebounding effect. Variations in ambient conditions and the aging process of materials may cause the netting material to stretch over time and may produce fatigue in the springs, such as in the form of cyclic creep or plastic deformation. This slack and fatigue can occur very quickly in known systems, many times just from the initial use of the rebounding device if the net has not been pre-tensioned and significantly before the net and springs are near any failure, but they result in much worse rebounding performance and many times lead to replacement of the net and springs that may have otherwise been in good condition. In prior rebounding devices, the frames do not provide any mechanisms to reduce this slack as the nets and springs begin to wear down. In comparison, the spring action in the frame of the present invention also serves to take out any initial loosening of the netting material. To provide the spring action when the tension is pulled on the net, the tubular sections of the frame can deflect, bow or otherwise flex some distance (f) from the straight axis between the corners of the frame. The bowed tubular sections can have a deflection (f) greater than approximately two diameters (2*d) of the tension rod. Another measure of the maximum deflection (f) is that it can be approximately equal to the diameter (D) of the frame's tubular sections.

The posts that are secured by the ground foundation do not require any base cross-beams, and the frame of the net can be lowered all the way to the ground. For the nets that are held between posts that are installed on a stationary mount or positioned on a mobile platform, the posts are preferably connected to base rails that extend substantially perpendicular to the vertical plane of the net and which are connected by cross-beams. Both of the cross-beams can be positioned toward the back side of the vertical net so that the net can be lowered all the way to the ground, thereby permitting rebounding of ground balls for soccer and many baseball grounders. Even when the base rail and cross-beams are elevated on casters or other wheels, the fasteners holding the frame's side perimeter supports in the tilting hub's T-joints can be loosened and the frame can slide within the joints to reach the ground. Additionally, the ability to hold the rods within the frame with fasteners that can be positioned at various locations along frame allows the frame to be lowered to the ground even when the frame is inclined. Examples of alternative designs that can be used for a similar base are shown in FIG. 7C, with one design having a straight connection and between the base and the side posts and the other design having a gooseneck in which the base extends around the front and upwardly to the side post.

Figure 7J:
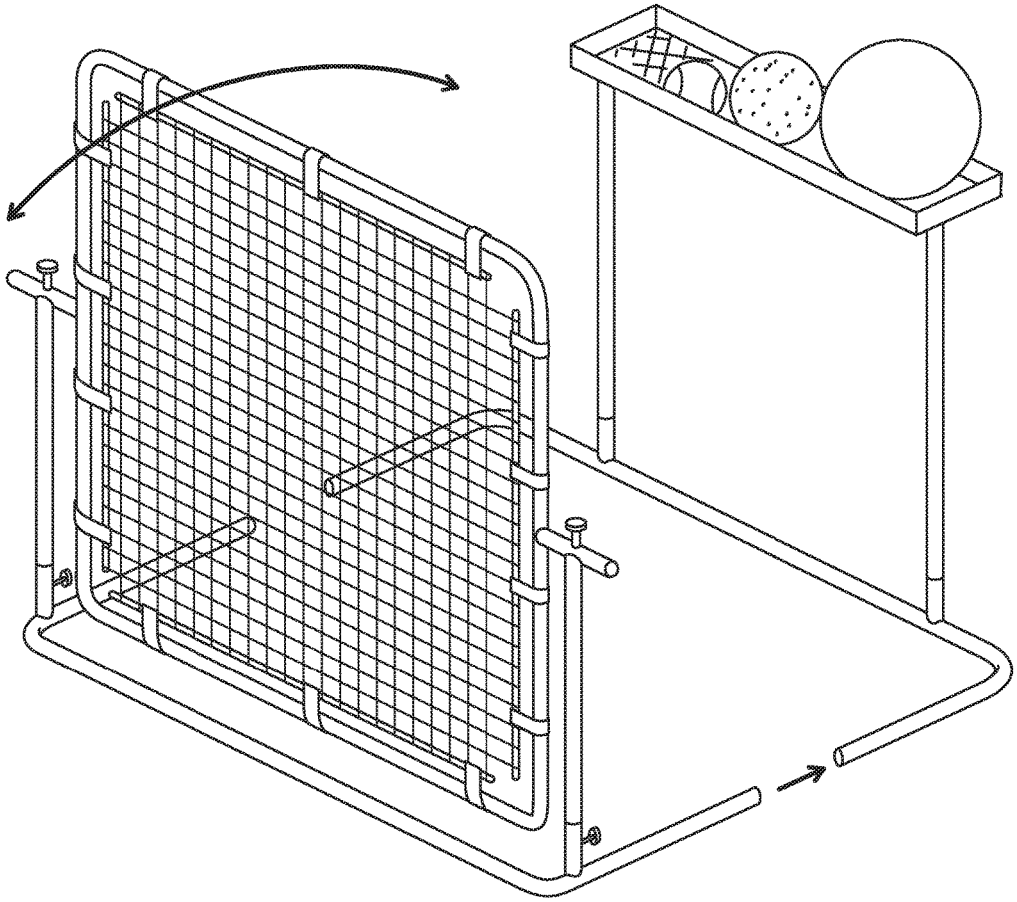
Figure 8A:
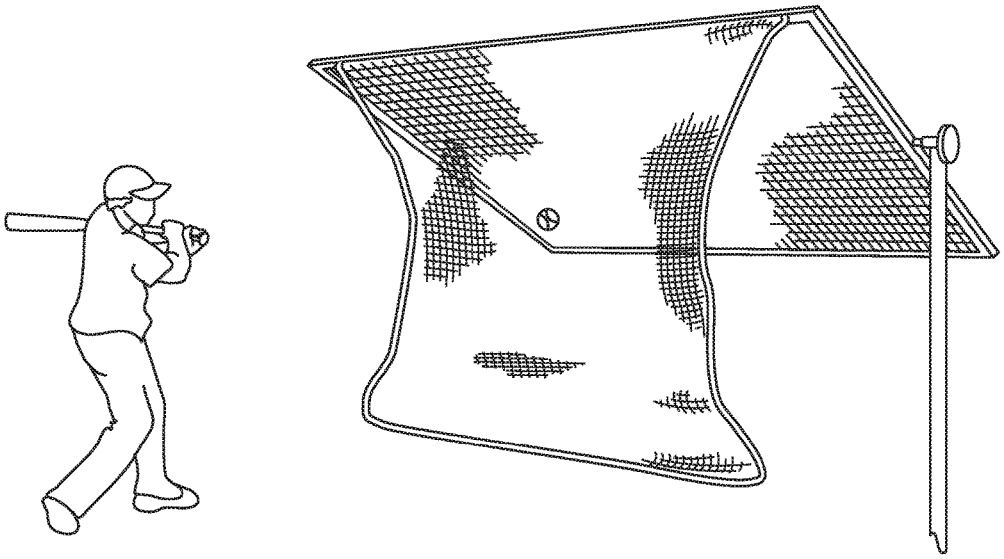
FIGS. 8A & 8B are views of rebounders with a dead blow sheet.
Figure 8B:
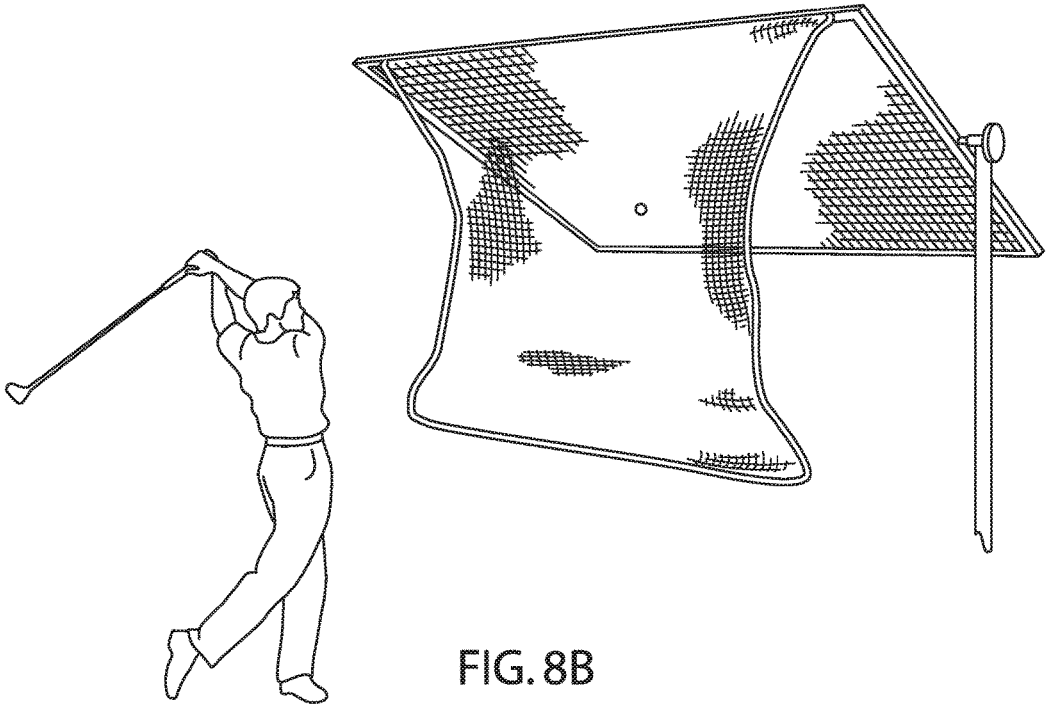

While many of the embodiments are shown as they may be used for various sports, such as soccer, lacrosse, football, baseball, softball, cricket, tennis, volleyball, golf, hockey and basketball, as particularly shown in FIG. 7J, the present invention may also be used as a physical therapy device, as its own fitness trainer or even as part of other exercise equipment. Conventional therapy devices and trainers are not well suited for lighter weight balls, and the present invention will permit light balls and heavier medicine balls to all be used depending on the ability of the users. The trainer device will improve the user's physical abilities, including hand and eye coordination, reflex speed, agility, balance and coordination, and cardio fitness. The therapy version is beneficial for users who cannot use the heavier weights and impacts that are typically required by traditional medicine ball trainers. In the particular embodiment, balls can be stored on a shelf with the trainer or any other holding device. As with the sports versions of the invention, the frame for the therapy version can be rotatably held by a pair of tilting hubs or other rotation brackets so that the user can adjust the tilt angle.

According to the ball rebounding system of the present invention, the combination of the orthogonal tension rods and the lever system nearly triple and at least double the tension in nets as compared with ball rebounding devices that use springs. Additionally, the present invention allows the same tension rods and lever system to be used for nets that have different sized cells as well as screens or other fabrics. The lever system of the present invention provides for faster and more efficient assembly of the net within the frame because the entire length of the rod can be pulled simultaneously. The ball rebounding system of the present invention can also be used to replace the nets and springs or fasteners in existing ball rebounding frames to provide a better rebound effect, and the retrofitting of the nets with the laced rods and fasteners can be provided in a kit with the lever system, optionally with pre-laced rods, so that the present invention is less time consuming than the process necessary to install the original nets.

An example of a retrofitted frame is shown in FIG. 12. The original frame with bungee cords or other spring elements holding the net in place is shown in FIG. 12A. One retrofitted rebounding device, shown in FIG. 12B, has its own frame, tension rods and net strapped onto the existing frame. However, while this retrofit is extremely easy to install, it is aesthetically unappealing and does not take advantage of the strength of the existing frame. Another retrofitted rebounding device, shown in FIG. 12C, uses the existing frame to pull the tension rods and thereby tighten the net. As indicated above, the double-frame inventions are not suitable for retrofitting existing rebounding devices because they would require drilling through metal frames to secure the inner frames at particular fixation locations that are required to hold the inner frames in place. In comparison, as described above with reference to FIG. 9 and shown in FIG. 12E, the tension rods can be pulled within the outer frame using any one of the lever mechanisms described above and shown in FIG. 11, and they can be secured with cam straps or cord straps as shown in FIGS. 12G and 12H or any other type of strap, tie or other fastener as described above. As shown in FIG. 12I, a retrofit unit could also be installed to an existing frame through rotation brackets which permits the inner unit to tilt or otherwise rotate relative to the existing frame to various angles that may be desired by the user. As shown by the detail view of the mounting bracket in FIG. 12J, the bracket could mount on the frame of an existing rebounder, and the retrofit frame could have an extension that slides into a sleeve in the bracket. The bracket could have a threaded hole with a knob-head bolt or other type of bolt that secures the tilt angle of the retrofit frame within the existing frame.

Figure 10A:
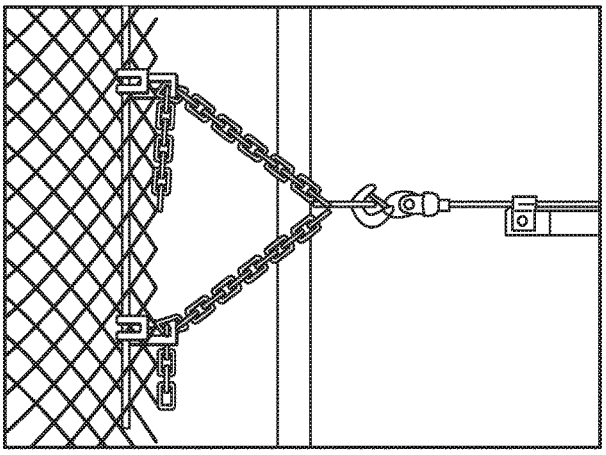
FIGS. 10A-10E are views of alternative leverage mechanisms.
Figure 10B:
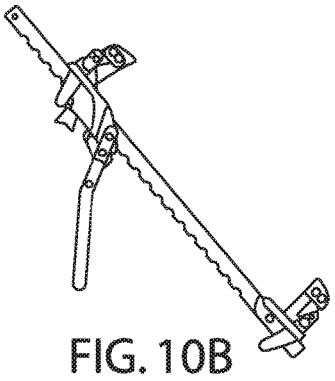
Figure 10C:
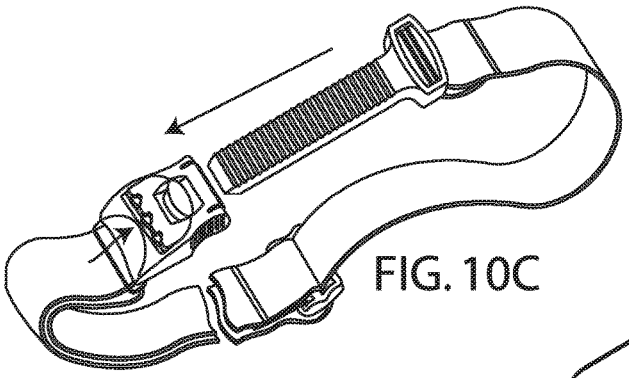
Figure 10D:
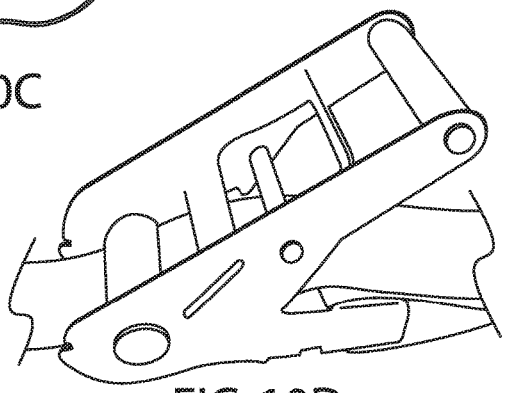
Figure 10E:
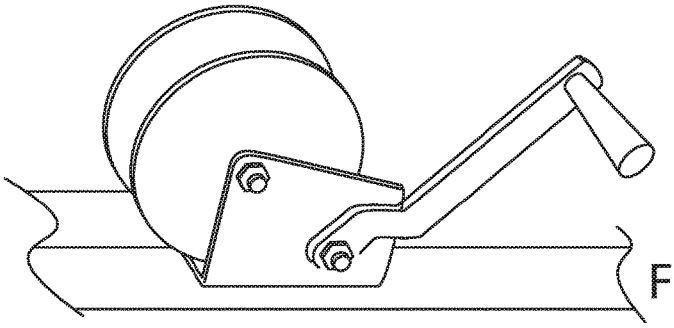
Figure 11A:
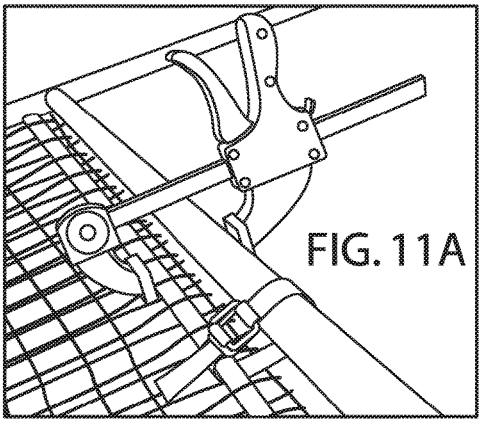
FIGS. 11A-11E are views of an alternative assembly method.
Figure 11B:
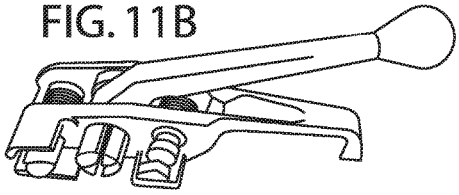
Figure 11C:
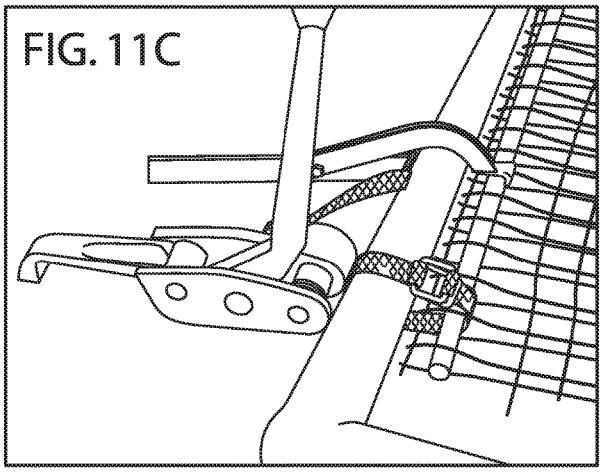
Figure 11D:
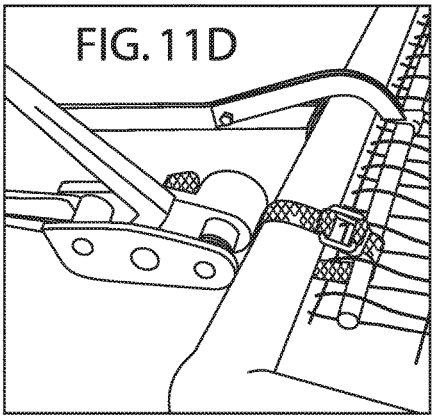
Figure 11E:
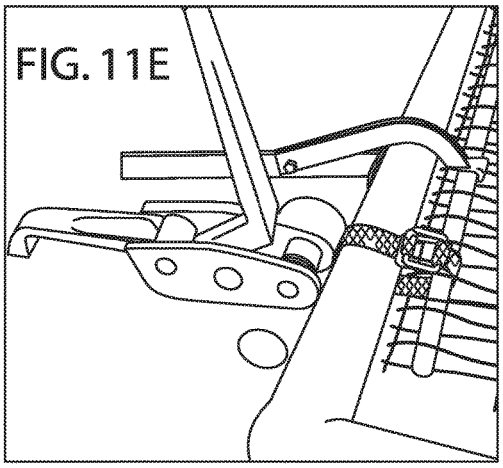
Figure 12A:
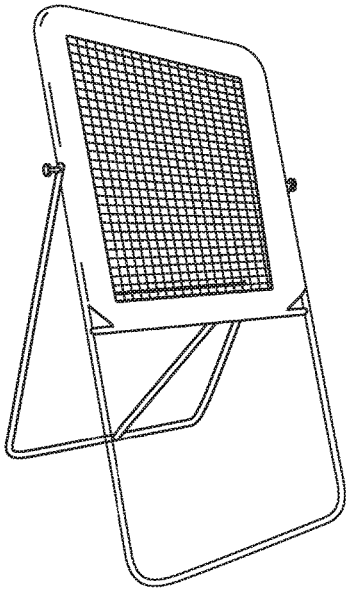
FIG. 12A (PRIOR ART)
FIGS. 12A and 12B-12J are views of an existing rebounder and retrofit options of the existing rebounder, respectively.
Figure 12B:
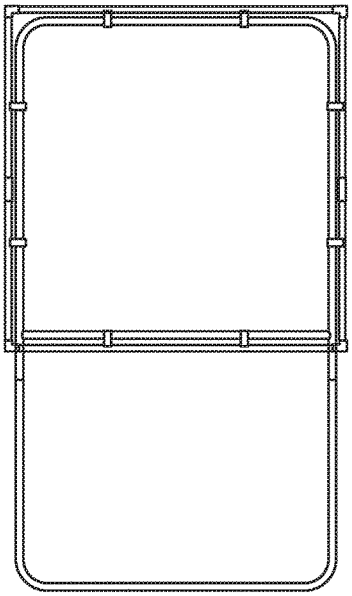
Figure 12C:
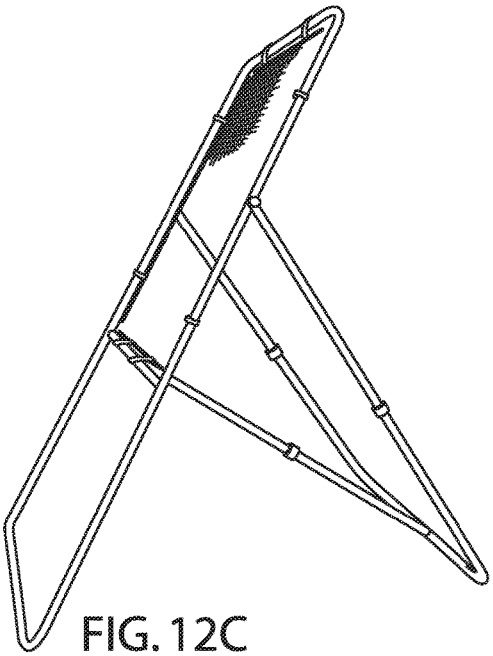
Figure 12D:
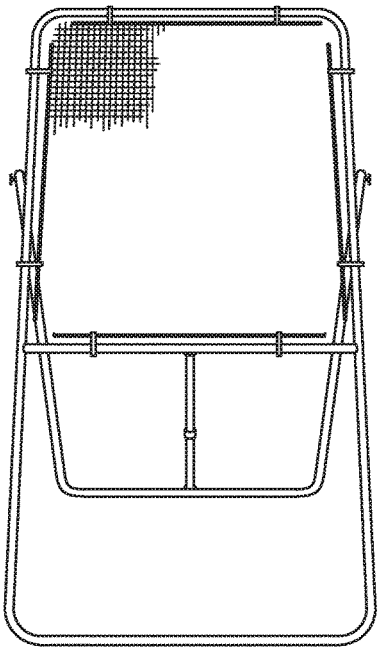
Figure 12E:
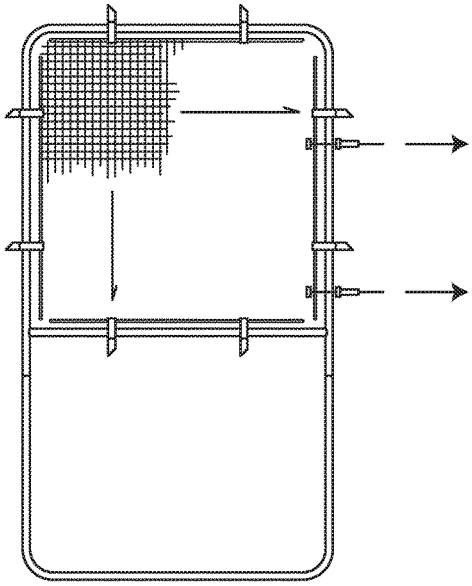
Figure 12F:
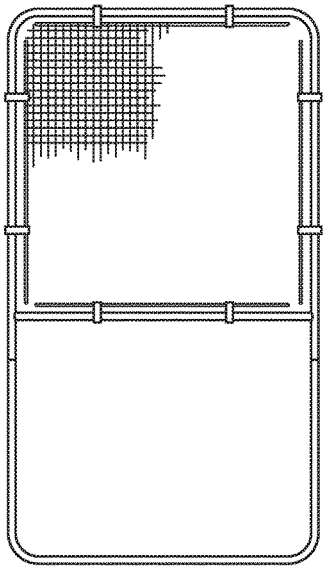
Figure 12G:
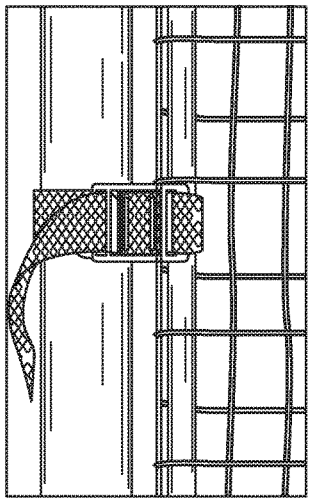
Figure 12H:
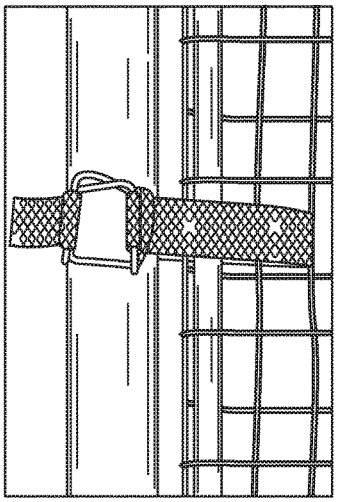
Figure 12I:
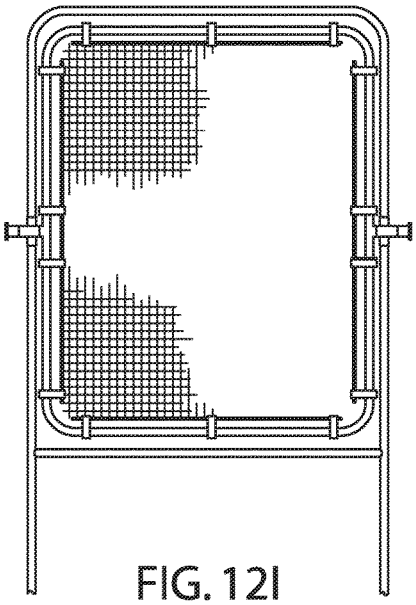
Figure 12J:
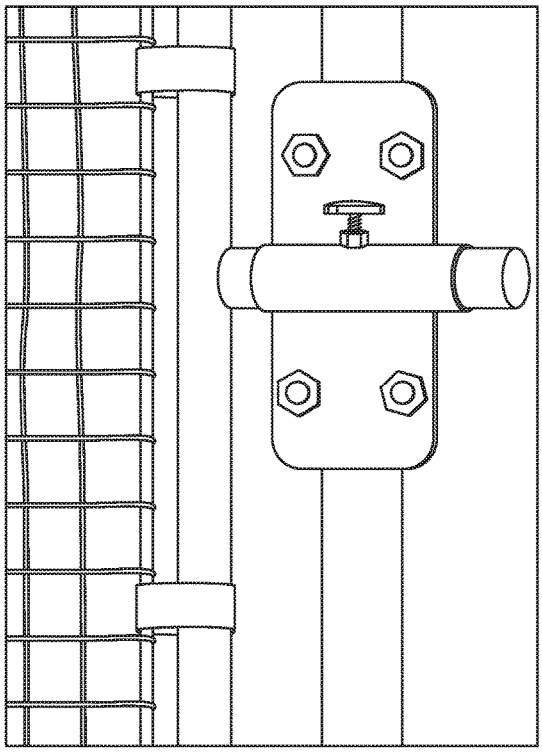

As particularly shown in FIGS. 11A-11E, one lever may be used to pull the rod close to the frame and a ratcheting strap tensioner can be used to pull the rod even closer to the frame with a strap that is used to secure the tension rod. When straps are used to secure the tension rods in position proximate to the frame, they are preferably coated with an epoxy that secures the loose ends of the straps to the portion of the strap that is wrapped around the frame and the tension rod. The addition of the epoxy prevents the straps from slipping during repeated rebounding cycles that vary the tension on the straps. Other ways to secure the loose ends of the straps could also be used. For example, hook and loop fastener elements can be provided on the strap ends and wrapped section, respectively. Of course, it will also be appreciated that the ends can simply be tied together. It will also be appreciated that one or more ratcheting strap tensioners may be used by itself without any other leveraging devices, and inexpensive versions of a ratcheting strap tensioner, such as shown in FIG. 10C, may be permanently fixed to the frame to allow the user to adjust the net tension over time and for various uses.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although the preferred embodiments use tension rods, it will be appreciated that bars, tubes, beams could alternatively be used within the frame in place of the rods. Thus, the breadth and scope of the present invention should not be limited by any of the above-described exemplary embodiments, but should be defined only in accordance with the following claims appended hereto and their equivalents.

What is claimed is:

1. A rebounder for a ball, comprising:

a frame comprising a perimeter support and an interior space within the perimeter support;

a first pair of tension rods arranged parallel to each other on opposite sides of the interior space, wherein each of the tension rods is movable within the interior space between a first position in which each tensions rod is spaced apart from the perimeter support within the interior space, and a second position in which each tension rod is spaced apart from the perimeter support within the interior space but closer to the perimeter support than in the first position;

an inelastic net comprising a plurality of cells, wherein the net is disposed within the interior space of the frame, and wherein rows of the cells proximate to a boundary of the net are connected to the tension rods, and wherein the rows of the cells are directly laced onto the tension rods; and a plurality of inelastic fasteners connecting the tension rods to the frame when the tension rods are in the second position;

wherein the net is in a slackened state when the tension rods are in the first position, and wherein the net is in a taut state when the tension rods are in the second position; and wherein the perimeter support of the frame is straight when the tension rods are in the first position, and wherein the perimeter support is bowed inwardly toward at least one of the tension rods when the tension rods are in the second position.

2. The rebounder of claim 1, further comprising a second pair of tension rods, wherein the second pair of tension rods are arranged parallel relative to each other and orthogonal to the first pair of tension rods.

3. The rebounder of claim 1, wherein the inelastic fasteners are at locations spaced along the tension rods and the perimeter support within the rows of the cells.

4. The rebounder of claim 3, wherein the inelastic fasteners comprise straps wrapped around the tension rods and the perimeter support, wherein the straps loosely hold the tension rods in the first position and wherein the straps securely hold the tension rods in the second position.

5. The rebounder of claim 1, further comprising a base, a pair of legs, and a pair of rotation brackets, wherein the rotation brackets connect the pair of legs to opposite sides of the frame, wherein the base is positioned below a bottom of the frame, wherein the pair of legs connect the pair of rotation brackets to the base, and wherein the frame rotates through the rotation brackets to a range of rotation angles relative to the pair of legs.

6. The rebounder of claim 5, wherein at least one of the rotation brackets is further comprised of a locking element, wherein the locking element secures the frame at a selected angular tilt within the range of rotation angles.

7. The rebounder of claim 1, wherein the perimeter support of the frame is further comprised of a top support, a bottom support, and a pair of side supports connecting the top support to the bottom support, wherein the top support and the bottom support each bow inwardly toward each other when the when the tension rods are in the second position, wherein the pair of side supports bow inwardly toward each other when the tension rods are in the second position.

8. The rebounder of claim 1, wherein the perimeter support is inwardly bowed an amount greater than an outer dimension of the tension rod.

9. A rebounder for a ball, comprising:

a frame comprising a perimeter support and an interior space within the perimeter support, wherein the perimeter support is further comprised of a top support, a bottom support, and a pair of side supports connecting the top support to the bottom support;

a base, wherein the base is positioned in a horizontal plane below the bottom support of the frame;

a pair of legs, wherein each of the pair of legs has a proximal end connected to the base and extend substantially perpendicular to the horizontal plane to a distal end;

a pair of rotation brackets, wherein the rotation brackets connect the pair of legs to the respective pair of side supports, wherein the frame rotates through the rotation brackets to a range of rotation angles relative to the pair of legs, wherein at least one of the rotation brackets is further comprised of a locking element, wherein the locking element secures the frame at a selected angular tilt within the range of rotation angles;

a first pair of tension rods, wherein each of the tension rods has a first position spaced apart from the perimeter support within the interior space, and a second position spaced apart from the perimeter support within the interior space and more proximate to the perimeter support within the interior space than in the first position;

an inelastic net comprising a plurality of cells, wherein the net extends between the perimeter support within the interior space of the frame, and wherein rows of the cells proximate to a boundary of the net are connected to the tension rod; and a plurality of inelastic fasteners connecting the tension rods to the frame, wherein the inelastic fasteners connect the tension rods to the frame; and wherein the top support, the bottom support, and the pair of side supports are straight when the tension rods are in the first position, and wherein the top support and the bottom support are bowed inwardly toward each other and the pair of side supports are bowed inwardly toward each other when the tension rods are in the second position.

10. The rebounder of claim 9, wherein the inelastic fasteners comprise straps wrapped around the tension rods and the perimeter support, wherein the straps loosely hold the tension rods in the first position, wherein the straps securely hold the tension rods in the second position, wherein the net is in a slackened state when the straps are in the first position, and wherein the net is in a taut state when the straps are in the second position.

* * * * *